United States Patent [19]

Mizuno

[11] 4,000,762

[45] Jan. 4, 1977

[54] YARN DRAWING AND MEASURING DEVICE OF A WEAVING LOOM

[75] Inventor: Yukio Mizuno, Kodaira, Japan

[73] Assignee: Nissan Motor Company, Limited, Japan

[22] Filed: Mar. 3, 1975

[21] Appl. No.: 555,027

[30] Foreign Application Priority Data

May 15, 1974 Japan ..... 49-54205
May 15, 1974 Japan ..... 49-54206

[52] U.S. Cl. ..... 139/452; 226/187

[51] Int. Cl.[2] ..... D03D 47/34

[58] Field of Search ..... 139/122 H, 122 W, 122 R, 139/127 R, 127 P, 450–453; 226/178, 184, 186, 187; 66/132

[56] References Cited

UNITED STATES PATENTS

| | | | |
|---|---|---|---|
| 2,662,556 | 12/1953 | Svaty | 139/127 P |
| 2,990,092 | 6/1961 | Begun et al. | 226/187 X |
| 3,140,633 | 7/1964 | Vincent | 139/127 P |
| 3,318,502 | 5/1967 | Horna | 226/187 X |
| 3,370,618 | 2/1968 | Svaty et al. | 139/122 H |
| 3,478,945 | 11/1969 | Cooke | 226/187 X |
| 3,587,961 | 6/1971 | Ritter | 226/187 X |
| 3,701,608 | 10/1972 | Sanjo et al. | 226/187 X |
| 3,711,003 | 1/1973 | Boyer et al. | 226/187 X |
| 3,776,282 | 12/1973 | Sevcik et al. | 139/122 H |
| 3,799,212 | 3/1974 | Stanislav et al. | 139/122 H |
| 3,833,028 | 9/1974 | Chattaway et al. | 139/122 H |
| 3,915,199 | 10/1975 | Kida | 139/452 |

FOREIGN PATENTS OR APPLICATIONS

| | | | |
|---|---|---|---|
| 2,016,184 | 10/1971 | Germany | 139/122 H |

*Primary Examiner*—James Kee Chi
*Attorney, Agent, or Firm*—Robert E. Burns; Emmanuel J. Lobato; Bruce L. Adams

[57] ABSTRACT

Improvements are made in a weft yarn drawing and measuring device for a weaving loom in which a weft yarn to be picked into a shed of the loom is drawn off to a predetermined length by means of measuring and pressing rollers driven for rotation about horizontal axis. The pressing roller is constantly driven at a circumferential speed equal to the circumferential speed of rotation of the measuring roller and is movable between a position disengaged from the measuring roller for allowing the leading end of the weft yarn to rest on the measuring roller and a position in rolling contact with the measuring roller for drawing off the yarn gripped between the two rollers. The device is characterized by self-adjustable torque transmission means capable of transmitting a driving torque to the pressing roller and having an allowance for the movement of the pressing roller between the two relative positions thereof to the measuring roller.

20 Claims, 20 Drawing Figures

YARN DRAWING AND MEASURING DEVICE OF A WEAVING LOOM

The present invention relates to weaving looms and, more particularly, to a yarn drawing and measuring device incorporated in a weaving loom for selectively drawing off weft yarns to prescribed lengths before the weft yarns are picked into the shed of the loom.

One ordinary example of the prior art yarn drawing and measuring device of a weaving loom consists of a combination of a measuring roller driven for rotation about a horizontal axis at a speed related to the operating speed of the loom and a pressing roller which is constantly held in rolling contact with the measuring roller and is thus driven by the measuring roller at a speed substantially equal to the circumferential speed of the measuring roller during operation of the loom. A weft yarn leading from a yarn supply package is fed in between the measuring and pressing rollers at a scheduled timing and passed therethrough for a predetermined period of time for being drawn off toward the weaving shed a prescribed length in each of measuring and drawing cycles. Not only extremely sophisticated techniques are required for properly inserting the yarn in between the two rotating rollers but difficulties are encountered in precisely controlling the timings at which the yarn is to be securely gripped between the rollers, tending to cause a shortage of the length of the yarn to be picked and to produce undesirable mottles in a fabric woven.

Another example of the known yarn drawing and measuring device uses a pressing roller which is so arranged as to be movable into and out of rolling contact with a measuring roller with the free end of the weft yarn constantly received on the measuring roller. The measuring and pressing rollers are respectively provided with gears having diameters substantially equal to the diameter of the associated rollers and constantly held in mesh with each other. When the weft yarn on the measuring roller is to be drawn off and measured for a predetermined legnth, the pressing roller is moved into rolling contact with the measuring roller for retaining the yarn between the two rollers. The pressing roller is thus driven to rotate at a circumferential speed approximately equal to the circumferential speed of the measuring roller and thus draws off the yarn until the pressing roller is disengaged from the measuring roller. In the prior art yarn drawing and measuring device thus arranged, it is important to provide means adapted to elastically hold the pressing roller against the measuring roller in such a manner that a constant and uniform pressing force is applied from the pressing roller to the measuring roller. For this reason, the pressing roller is allowed to minutely move relative to the measuring roller so that the distance between the axes of rotation of the two rollers varies while the pressing roller is rotating on the measuring roller. The driven gear connected to the pressing roller is consequently made unable to maintain its pitch circle in rolling contact with the pitch circle of the driving gear connected to the measuring roller and thus fails to be rotated at a constant circumferential speed. This causes the pressing roller to slip on the measuring roller while the former is rotating on the latter. Not only abrasive forces are thus exerted on the rollers but a force is produced which acts to forcibly stretch the weft yarn being passed between the rollers, giving cause for the rupture of the filaments constituting the yarn and for the breakage of the yarn being drawn off. These problems may be solved if a suitable arrangement is made so that the gear connected to the measuring and pressing rollers are permitted to rotate with their pitch circles constantly held in rolling contact with each other. In view, however, of the extremely high revolution speeds of the gears (the revolution speed of the driven gear reaches about 6688 rpm if, for example, the desired width of gray cloth is 2100 mm, the diameter of the pressing roller is 60 mm and the operating speed of the loom is 600 rpm), the properly meshed condition of the gears could not be maintained without use of a lubricating oil which prevents the gears from being subjected to undue abrasion. The lubricating oil thus applied to the gears tends to be splashed on the weft yarns being passed through the measuring and pressing rollers and is in the result causative of contamination of the fabric produced.

These problems can be eliminated if the gears are removed from the measuring and pressing rollers so that no driving effort is given to the pressing roller when the pressing roller is disengaged from the measuring roller. The pressing roller disengaged from the measuring roller is held at rest or kept rotating by the inertia thereof so that, when the pressing roller is brought into rolling contact with the measuring roller in a measuring cycle of the device, it takes some time for the pressing roller to reach a circumferential speed equal to the circumferential speed of the driving or measuring roller. The pressing roller is thus driven to rotate at a circumferential speed lower than that of the measuring roller during an incipient stage of each measuring cycle and, as a consequence, applies a traction or braking force to the yarn being passed between the two rollers. The yarn is thus caused to slip on the peripheral surface of and pressing roller until the pressing roller is sped up to the circumferential speed substantially matched with the circumferential speed of the measuring roller. This will, again, result in a shortage of the measured-off length of the weft yarn, the breakage of the yarn and/or the rupture of the filaments making up the yarn.

The present invention contemplates provision of a yarn drawing and measuring device which is free from all the above mentioned drawbacks of the prior art yarn drawing and measuring devices and, accordingly, it is an important object of the present invention to provide an improved yarn drawing and measuring device which is capable of smoothly and accurately drawing off a weft yarn to predetermined length.

It is another important object of the invention to provide an improved yarn drawing and measuring device having measuring and pressing rollers which are so arranged as to prevent a weft yarn from being subjected to traction or slippage when the weft yarn is fed between the rollers.

It is still another important object of the invention to provide an improved yarn drawing and measuring device having a pressing roller which can be readily moved into and out of rolling contact with a measuring roller and which is adapted to be driven for rotation at a circumferential speed substantially equal to the circumferential speed of a measuring roller throughout the time duration of every drawing and measuring cycle.

It is still another important object of the invention to provide an improved yarn drawing and measuring device having a pressing roller which is adapted to be kept driven throughout the operation of the device, viz., not only when the pressing roller is in rolling contact with the measuring roller during the drawing and measuring cycle but when the pressing roller is disengaged from the measuring roller.

It is still another important object of the invention to provide an improved yarn drawing and measuring device having a pressing roller which can be kept driven throughout the operating period of the device without aid of gears or other mechanical members which must be lubricated with oil or other liquid which may form a cause of contamination of a fabric to be produced.

It is still another important object of the invention to provide an improved yarn drawing and measuring device which will dispense with sophisticated techniques in feeding a weft yarn in between the measuring and pressing rollers in each of the drawing and measuring cycles.

It is still another important object of the invention to provide an improved yarn drawing and measuring device which is adapted to prevent a weft yarn from being cut or having its filaments ruptured while the yarn is being drawn off through the measuring and pressing rollers.

Yet, it is another object of the present invention to provide an improved yarn drawing and measuring device which has a simple and economical construction and which may be readily incorporated into an existing weaving loom without making extensive modification of the loom.

In accordance with the present invention, these objects will be accomplished basically in a yarn drawing and measuring device which comprises, in combination, at least one measuring roller which is rotatable about a substantially horizontal axis, pressing means including at least one pressing roller which is rotatable about an axis substantially parallel to the horizontal axis of rotation of said measuring roller and which is movable between a first relative position disengaged or spaced upwardly from the measuring roller and a second relative position in rolling contact with the measuring roller, positioning means for selectively moving the pressing roller between the first and second relative positions thereof, the positioning means having a first condition holding the pressing roller in the first relative position thereof and a second condition holding the pressing roller in the second relative position thereof, and driving means for driving the pressing roller for rotation in a direction opposite to the direction of rotation of the measuring roller at a circumferential speed substantially equal to the circumferential speed of rotation of the measuring roller in whichsoever relative position the pressing roller may be held by the positioning means throughout the operation of the yarn drawing and measuring device, the driving means including self-adjustable torque transmission means having an allowance for the movement of the pressing roller between the first and second relative positions.

In accordance with one important aspect of the present invention, the self-adjustable driving means forming part of the driving means for the pressing roller comprise at least one deformable member which is in constant engagement with the pressing roller and which is elastically deformable responsive to the movement of the pressing roller between the first and second relative positions thereof.

In accordance with another important aspect of the present invention, the driving means further include a driving roller which is rotatable about an axis substantially parallel to the axes of rotation of the measuring and pressing rollers and which is connected to the pressing roller by the self-adjustable torque transmission means, the pressing roller having its axis of rotation substantially in alignment with the axis of rotation of the driving roller when the pressing roller is in either of the first and second relative positions thereof and out of alignment with the axis of rotation of the driving roller when the pressing roller is in the other of the first and second relative positions thereof, the driving roller being driven to drive the pressing roller through the self-adjustable torque transmission means throughout the operation of the yarn drawing and measuring device. In this instance, the self-adjustable torque transmission means forming part of the driving means for the pressing roller may comprise a first projection on the inner side face of either of the pressing and driving rollers and a pair of spaced parallel second projections on the inner face of the other of the pressing and driving rollers, wherein the first projection is movably received between the second projections and is in sliding engagement with either of the second projections for thereby transmitting a driving torque from the driving roller to the pressing roller through the sliding engagement between the first and second projections when the driving roller is rotated and irrespective of the relative position of the pressing roller to the driving roller.

The above mentioned driving roller may be in rolling contact with the measuring roller or connected through a belt and pulley arrangement to the measuring roller for being driven by the measuring roller for rotation at a circumferential speed substantially equal to the circumferential speed of rotation of the measuring roller. Or otherwise, the driving roller may be driven from an external driving source through, for example, another driving roller which is driven by the external driving source and which is in rolling contact with the former driving roller.

In accordance with still another important aspect of the present invention, the driving means for the pressing roller further include an articulated belt and pulley arrangement which consists of a driving pulley rotatable about an axis substantially parallel to the axes of rotation of the measuring and pressing rollers and which is driven for rotation by an external driving source in a direction opposite to the direction of rotation of the measuring roller, a driven pulley rotatable with the pressing roller and movable with the pressing roller when the pressing roller is moved between the first and second relative positions thereof, an intermediate pulley which is rotatable about an axis substantially parallel to the axes of rotation of the measuring and pressing rollers and located intermediate between the driving and driven pulleys partly in line with the driving pulley and partly in line with the driven pulley, a first endless belting passed on the driving and intermediate pulleys for transmitting the rotation of the driving pulley to the intermediate pulley, and a second endless belting passed on the intermediate and driven pulleys for transmitting the rotation of the intermediate pulley to the driven pulley for thereby driving the pressing roller for rotation about its axis. In this instance, the combination of the intermediate and driven pulleys and the second endless belting consitutues the self-adjustable torque transmission means, having the driven pulley and second endless belting slightly turned about the axis of rotation of the intermediate pulley when the pressing roller is moved, or turned, between the first and second relative positions thereof.

Other features of the yarn drawing and measuring device according to the present invention will become apparent from the following description taken in conjunction with the accompanying drawings, in which.

Figure 19:
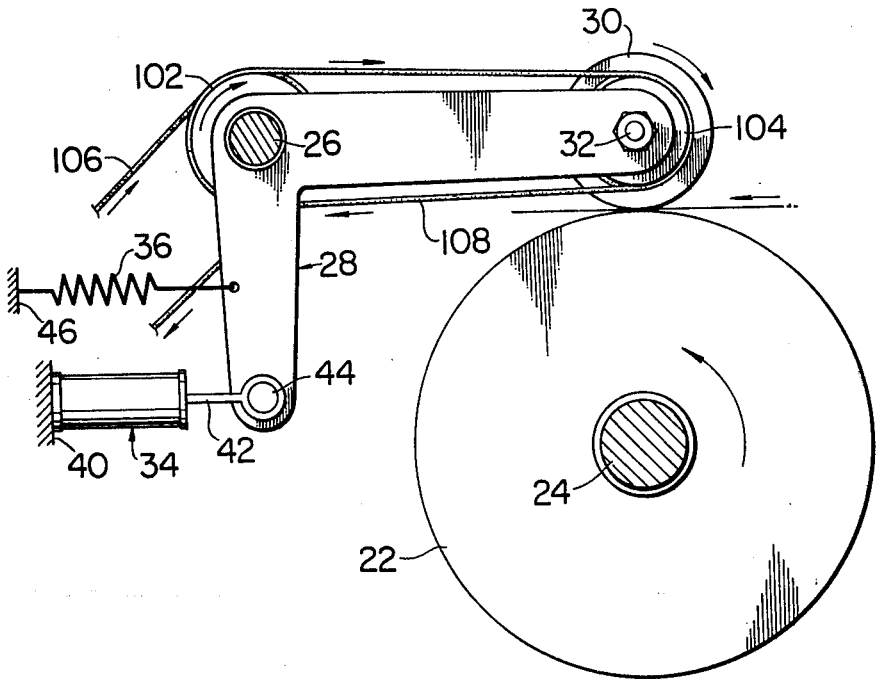
FIG. 19 is a side elevational view showing a 12th preferred embodiment of the yarn drawing and measuring device according to the present invention.
Figure 20:
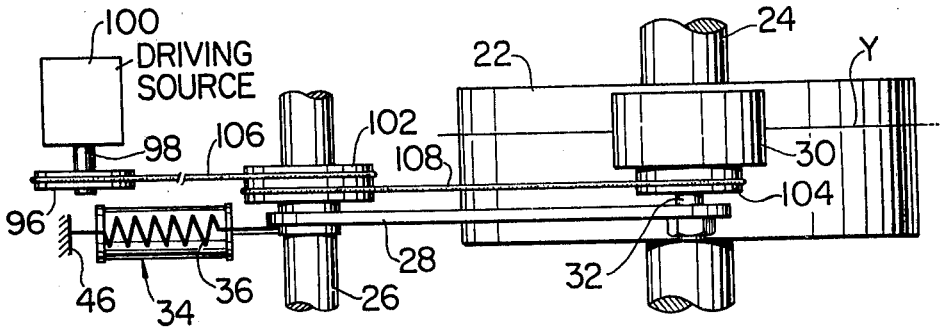
FIG. 20 is a top end view of the yarn drawing and measuring device illustrated in FIG. 19.

Of the various embodiments of the yarn drawing and measuring device according to the present invention, each of the first to eighth embodiments illustrated in FIGS. 1 to 11 use, as self-adjustable torque transmission means, a pliable connecting element interconnecting pressing and driving rollers and yieldable to the movement of the pressing roller into and out of engagement with a measuring roller. Each of the ninth to eleventh embodiments shown in FIGS. 12 to 18 is characterized by self-adjustable torque transmission means constituted by projections formed on the inner faces of the pressing and driving rollers. The twelfth embodiment illustrated in FIGS. 19 and 20 is characterized by self-adjustable torque transmission means constituted by a belt and pulley arrangement using at least two endless beltings formed of unstretchable material.

In all the figures of the drawings, like reference numerals designate corresponding parts and units. In each of the figures, moreover, conventional parts and units making up a weaving loom incorporating the yarn drawing and measuring device embodying the present invention have been removed for the sake of simplicity of illustration and because of the fact that such parts and units are immaterial for the understanding of the gist of the present invention. The relative position of the yarn drawing and measuring device embodying the present invention will, however, be quite readily understood from the direction of the weft yarn or yarns illustrated in each of the drawing figures.

Figure 1:
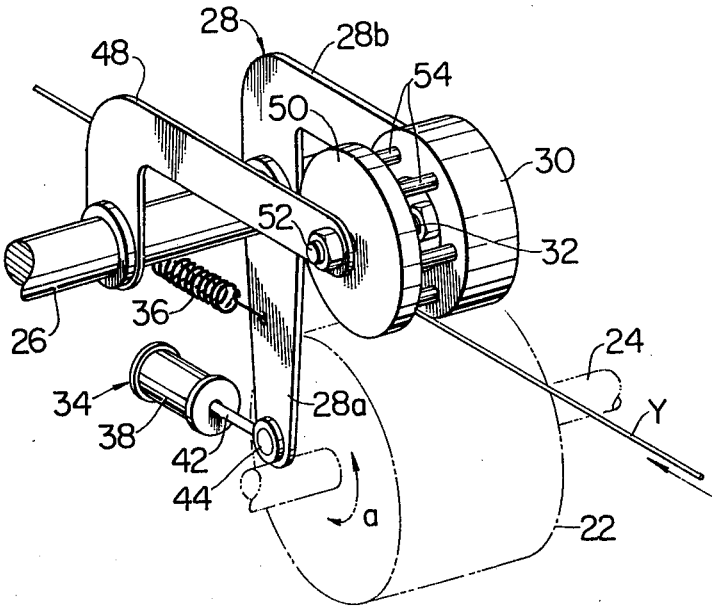
FIG. 1 is a perspective view which shows, partly in phantom, a first preferred embodiment of the yarn drawing and measuring device according to the present invention.
Figure 2:
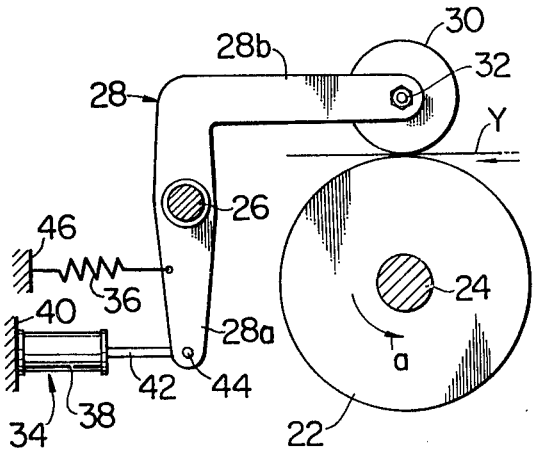
FIG. 2 is a side elevational view showing part of the yarn drawing and measuring device illustrated in FIG. 1 with driving means for a pressing roller removed to clearly show the position of the pressing roller relative to a measuring roller when the former is in rolling contact with the latter.
Figure 3:
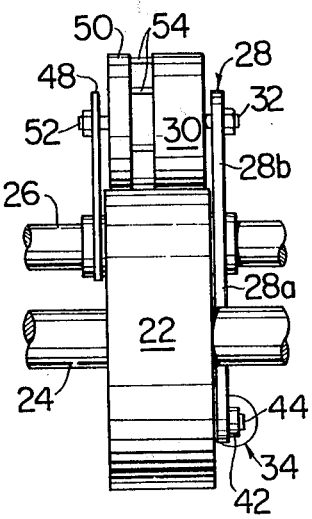
FIG. 3 is an end view of the yarn drawing and measuring device which is viewed forward from the rear of the device shown in FIG. 1.

Reference will now be made to the drawings, first concurrently to FIGS. 1 to 3 which illustrate a first preferred embodiment of the yarn drawing and measuring device according to the present invention. As illustrated, the yarn drawing and measuring device embodying the present invention comprises a measuring roller 22 of a drum form which is rotatable with a substantially horizontal shaft 24. The shaft 24 is connected to a driving source (not shown) of the loom and is thus driven to rotate at a speed proportional or otherwise suitably related to the operating speed of the loom so that the measuring roller 22 is driven for rotation with a circumferential speed which is proportional or otherwise related to the operating speed of the loom. The measuring roller 22 is assumed to be rotated in a direction indicated by an arrow *a*, viz., counterclockwise of FIG. 1 when the roller is viewed from the lefthand side of the drawing. In parallel to the shaft 24 is provided a stationary shaft 26 which is fixedly supported on a suitable fixed rigid member or structure (not shown) of the loom. The stationary shaft 26 has mounted thereon a bell-crank lever 28 having a lower arm portion 28*a* directed downward and an approximately horizontal arm portion 28*b* emerging from the top end of the lower arm portion 28*a* and terminating over the top of the measuring roller 22. The bell-crank lever 28 is pivotally mounted through its lower arm portion 28*a* on the stationary shaft 26 and is thus rotatable about an axis of the shaft 26. The bell-crank lever 28 carries at the leading end of its horizontal arm portion 28*b* a pressing roller 30 through a shaft or pin 32 which extends also in parallel to the shaft 24 supporting the measuring roller 22 above which the pressing roller 30 is positioned. The pressing roller 30 is thus rotatable about an axis of the shaft or pin 32 and is movable between a first relative position disengaged or spaced part from the measuring roller 22 as shown in FIG. 1 and a second relative position having the lower end of its peripheral surface in contact with the upper end of the peripheral surface of the measuring roller 22 as seen in FIGS. 2 and 3. The pressing roller 30 is moved between these first and second relative positions when the bell-crank lever 28 is rotated in either direction about the axis of the stationary shaft 26. The bell-crank lever 28 is thus assumed to be rotatable about the axis of the shaft 26 between a first angular position providing the first relative position of the pressing roller 30 to the measuring roller and a second angular position providing the second relative position of the pressing roller 30 to the measuring roller 22. The bell-crank lever 28 is driven to move between these first and second angular positions by driving means including a solenoid-operated cylinder 34 positioned at substantially right angles to the shafts 24 and 26 and resilient biasing means including a tension spring 36 by which the bell-crank lever 28 is preloaded. The solenoid-operated cylinder 34 is composed of a cylinder casing 38 connected at one axial end to a suitable stationary member or structure 40 (FIG. 2) forming part of the loom and a plunger 42 extending outwardly from the other axial end of the cylinder casing 38 toward the lower end of the lower arm portion 28*a* of the bell-crank lever 28. The plunger 42 is pivotally connected to the lower end of the lower arm portion 28*a* of the bellcrank lever 28 through a pivotal pin 44 having an axis directed in parallel to the shafts 24 and 26 so that the bell-crank lever 28 is rotatable about the axis of the pivotal pin 44 as the plunger 42 is moved forwardly and backwardly. The solenoid-operated cylinder 34 is arranged in such a manner as to cause the plunger 42 to forwardly move when the cylinder is energized from an external power source and to allow the plunger 42 in a freely movable condition when the cylinder is kept de-energized. The solenoid-operated cylinder 34 has a solenoid coil connected to the external power source through switching means controlled by control means programmed to actuate the cylinder 36 in accordance with predetermined schedules, though not shown in the drawings. Such control means may include, as is customary in the art, a mechanical cam and crank arrangement and a pattern card having pins tailored to the desired control schedules. The tension spring 36 is achored at one end to a stationary spring seat member 46 (FIG. 2) forming part of a framework structure of the loom and at the other end to the lower arm portion 28*a* of the bell-crank lever 28 so that the bell-crank lever 28 is biased toward the previously mentioned second angular position thereof by means of the tension spring 36. When, thus, the solenoid-operated cylinder 34 remains de-energized, the bell-crank lever 28 is unrestricted by the plunger 42 of the cylinder 34 and is rotated about the shaft 26 by the force of the tension spring 36 into the second angular position holding the pressing roller 30 in the previously mentioned second relative position contacting the measuring roller 22. When, conversely, the slenoid-operated cylinder 34 is energized from the external power source by the action of the above mentioned control means and accordingly the plunger 42 of the cylinder 34 is caused to forwardly project, the bell-crank lever 28 is rotated about the shaft 26 against the opposing force of the tension spring 36 into the previously defined first angular position thereof, moving the pressing roller 30 into the previously defined first relative position thereof, viz., out of contact with the measuring roller 22. The bell-crank lever 28, the solenoid-operated cylinder 34, and the tension spring 36 make up supporting and positioning means for the pressing roller 30 of the embodiment illustrated in FIGS. 1 to 3.

On the stationary shaft 26 is fixedly mounted a stationary arm 48 extending substantially in parallel to the upper horizontal arm portion 28*b* of the bell-crank lever 28 and terminating above the top end of the measuring roller 22 or in the neighbourhood of the leading end of the horizontal arm portion 28*b* of the bell-crank lever 28. The stationary arm 48 has carried at its leading or rearmost end a driving roller 50 through a pivotal pin 52 having an axis directed in parallel to the shaft 26, viz., with the pivotal pin 32 on the horizontal arm portion 28*b* of the bell-crank lever 28. The driving roller 50 has a diameter which is substantially equal to the diameter of the pressing roller 30 and is held in contact with the top end of the measuring roller 22. The axis of the pivotal pin 52 carrying the driving roller 50 is in line with the axis of the pivotal pin 32 carrying the pressing roller 30 when the pressing roller 30 is maintained in its second relative position contacting the measuring roller 22 as seen in FIG. 3. The axis of the pin 32 carrying the pressing roller 30 is slightly raised above the top end of the measuring roller 22 and is thus brought out of alignment with the axis of the pin 52 carrying the driving roller 50 when the pressing roller 30 is moved into its first relative position upwardly spaced apart from the top end of the measuring roller 22 as seen in FIG. 1. The pressing roller 30 and the driving roller 50 are elastically connected to each other by means of a suitable number of pliable connecting members 54 extending substantially in parallel to the axes of the pins 32 and 52 when the axes are aligned together. The pliable connecting members 54 are substantially uniformly spaced apart from each other around the aligned axes of the pins 32 and 52 or the axes of the driving roller 52 and the pressing roller 32 in the second relative position thereof and are assumed to be received at their ends in holes formed in the inner side walls of the rollers 30 and 50, as will be best seen in FIG. 1. The pliable connecting members 54 are, furthermore, assumed to be formed of urethane rubber and is shown, by way of example, as being provided six in number as will be seen from FIG. 1. The stationary arm 48, the driving roller 50 and the pliable connecting members 54 makes up, in combination, driving means for transmitting a driving force from the measuring roller 22 to the pressing roller 30 in the embodiment shown in FIGS. 1 to 3. The pliable connecting members 54 constitute self-adjustable torque transmission means for transmitting a driving torque from the driving roller 50 to the pressing roller 30 and yieldable to the movement of the pressing roller 30 between the first and second relative positions thereof. Designated by Y is a weft yarn leading from a yarn supply package such as a cone (not shown) positioned externally of the yarn drawing and measuring device. Where a plurality of weft yarns are to be selectively measured and picked into the weaving shed, a plurality of units each consisting of the pressing and driving rollers 30 and 50 arranged in the above described manner may be positioned over a common measuring roller or a plurality of measuring rollers respectively associated with the units.

The operation of the embodiment thus far described with reference to FIGS. 1 to 3 will now be described.

The measuring roller 22 is kept driven for rotation about the axis of the shaft 24 at a speed proportional or otherwise related to the operating speed of the weaving loom throughout the operation of the loom. The measuring roller 22 is thus constantly in driving engagement with the driving roller 50, which is accordingly driven to rotate about the axis of the pivotal pin 52 in a direction opposite to the direction of rotation of the measuring roller at a circumferential speed equal to that of the measuring roller 22. The driving torque thus imparted to the driving roller 50 is transmitted through the pliable connecting members 54 to the pressing roller 30 so that the pressing roller 30 is also kept driven to rotate about the axis of the pivotal pin 32 in the opposite direction to the direction of rotation of the measuring roller 22 and at a circumferential speed substantially equal to the circumferential speed of the measuring roller 22 because the pressing roller 30 is substantially equal in diameter to the driving roller 50. If, under these conditions, the pattern card for controlling the switch means for the exciting coil of the solenoid-operated cylinder 34 happens to be in a condition supplying a signal to energize the coil of the solenoid-operated cylinder 34, then the plunger 42 of the cylinder 34 is caused to project forwardly (viz., rearwardly of the yarn drawing and measuring device as a whole) and, through the pivotal connection between the plunger 42 and the lower arm portion 28*a* of the bell-crank lever 28, causes the bell-crank lever 28 to rotate counterclockwise of FIGS. 1 and 2 about the axis of the stationary shaft 26 against the opposing force of the tension spring 36. The bell-crank lever 28 is consequently moved into the first angular position thereof and thus holds the pressing roller 30 in the first relative position disengaged from the measuring roller 22. Although the pressing roller 30 is thus moved out of the position aligned with the driving roller 50, the pressing roller 30 is still kept driven to rotate about its axis at the circumferential speed substantially equal to the circumferential speed of the measuring roller 22 through the pliable connecting members 54 which are elastically deformed responsive to the displacement of the pressing roller 30. With the pressing roller 30 disengaged from the measuring roller 22, no drawing force is imparted to the weft yarn Y having its free foremost end received on the top end of the measuring roller 22.

When the solenoid-operated cylinder 34 is then de-energized under the control of the pattern card arrangement, the plunger 42 of the cylinder 34 is released from a magnetomotive force and is allowed to freely move relative to the cylinder casing 38. The tension spring 36 now causes the bell-crank lever 28 to rotate clockwise of FIGS. 1 and 2 about the axis of the stationary shaft 26 from the first angular position into the second angular position holding the pressing roller 30 into the second relative position thereof, viz., into rolling contact with the measuring roller 22, as seen in FIGS. 2 and 3. The weft yarn Y is in this manner gripped between the measuring and pressing rollers 22 and 30 rotating in the opposite directions but at a common circumferential speed and is thereby drawn off to a prescribed length until the solenoid operated cylinder 34 is for a second time energized and accordingly the pressing roller 30 is disengaged from the measuring roller 22. Because, thus, the pressing roller 30 is kept rotating even when the roller is disengaged from the measuring roller 22 and is brought into contact with the measuring roller 22 while being rotated at the circumferential speed substantially equal to the circumferential speed of the measuring roller 22, the pressing roller 30 is permitted to smoothly rotate on the measuring roller 22 throughout the measuring cycle, viz., even at an incipient stage of contact between the measuring and pressing rollers 22 and 30 so that substantially no traction or braking force is applied to the weft yarn Y being passed between the two rollers. The measured-off length of yarn Y is shot into the shed of the weaving loom and is woven into a fabric together with warp yarns.

Figure 4:
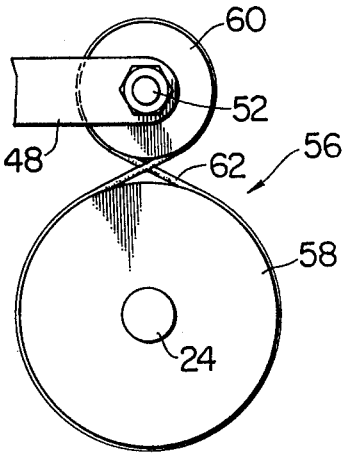
FIG. 4 is a side end view showing essential part of a second preferred embodiment of the yarn drawing and measuring device according to the present invention.
Figure 5:
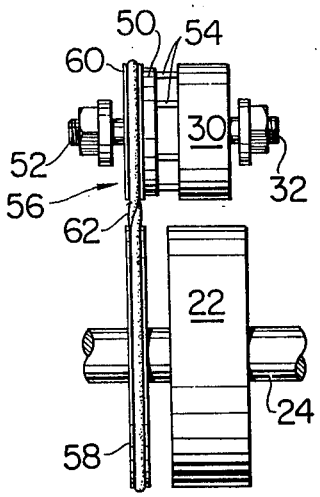
FIG. 5 is an end view of the yarn drawing and measuring device viewed forward from the rear of the device illustrated in FIG. 3.

FIGS. 4 and 5 illustrate a second preferred embodiment of the yarn drawning and measuring device according to the present invention. The embodiment herein shown is a modification of the first embodiment shown in FIGS. 1 to 3. While the driving force is imparted from the measuring roller 22 to the driving roller 30 through direct contact between the two rollers in the first embodiment illustrated in FIGS. 1 to 3, the driving roller 50 of the embodiment shown in FIGS. 4 and 5 is held in position at a spacing from the measuring roller 22 as will be better seen from FIG. 5 and is driven by the measuring roller 22 through a belt and pulley arrangement which is designated in its entirety by reference numeral 56. The belt and pulley arrangement 56 include a groove driving pulley 58 fixedly mounted on the shaft 24 and thus rotatable with the measuring roller 22 and a groove driven pulley 60 mounted on the pivotal pin 52 on the stationary arm 48 and thus rotatable with the driving roller 50. If desired, the driven pulley 60 may be fixedly secured to or formed integrally with the driving roller 50 as shown in FIG. 5. An endless belting 62 is passed in intermediately crossing relationship on the driving and driven pulleys 58 and 60 as will be better seen in FIG. 4. The driving force is thus constantly transmitted from the measuring roller 22 to the driving roller 50 through the driving pulley 58, the endless belting 62 and the driven pulley 60 and from the driving roller 50 to the pressing roller 30 through the pliable connecting members 54 elastically interconnecting the pressing and driving rollers 30 and 50. The driving roller 50 and accordingly the driven pulley 60 may be so positioned relative to the measuring roller 22 in such a manner as to have their axis of rotation aligned with the axis of rotation of the pressing roller moved into the first relative position thereof, viz., into the condition disengaged from the measuring roller 22 as shown in FIG. 5 or to have their axis of rotation alinged with the axis of rotation of the pressing roller 30 moved into the second relative position thereof, viz., into rolling contact with the measuring roller 22. If the former positioning of the driving roller 50 and the driven pulley 60 is preferred, the driving roller 50 may be spaced apart merely upwardly from the top end of the measuring roller 22 insofar as the driven pulley 60 is sideways spaced apart from the measuring roller 22 for preventing the endless belting 62 from being interfered with by the measuring roller 22. If, however, it is preferred that the driving roller 50 and the driven pulley 60 be positioned relative to the measuring roller 22 in the latter fashion, then both of the driving roller 50 and the driven pulley 60 should be spaced sideways apart from the measuring roller 22 so that not only the endless belting 62 but the driving roller 50 is kept away from the measuring roller 22. The driving and driven pulleys 58 and 60 are herein assumed and shown as having diameters which are substantially equal to the diameters of the measuring and driving rollers 22 and 50, respectively, because the diameter of the driving roller 50 is assumed to be substantially equal to the diameter of the pressing roller 30. The diameters of the driving and driven pulleys 58 and 60 may be, however, varied depending upon the ratio between the diameters of the measuring and pressing rollers 22 and 30 insofar as the circumferential speed of the pressing roller 30 can be equalized with the circumferential speed of the measuring roller 22. The driving means for the pressing roller 30 of the second embodiment of the yarn drawing and measuring device according to the present invention is, thus, made up of the belt and pulley arrangement 56 as well as the stationary arm 48, the driving roller 50 carried on the arm 48, and the pliable connecting members 54 elastically interconnecting the pressing and driving rollers 30 and 50.

Figure 6:
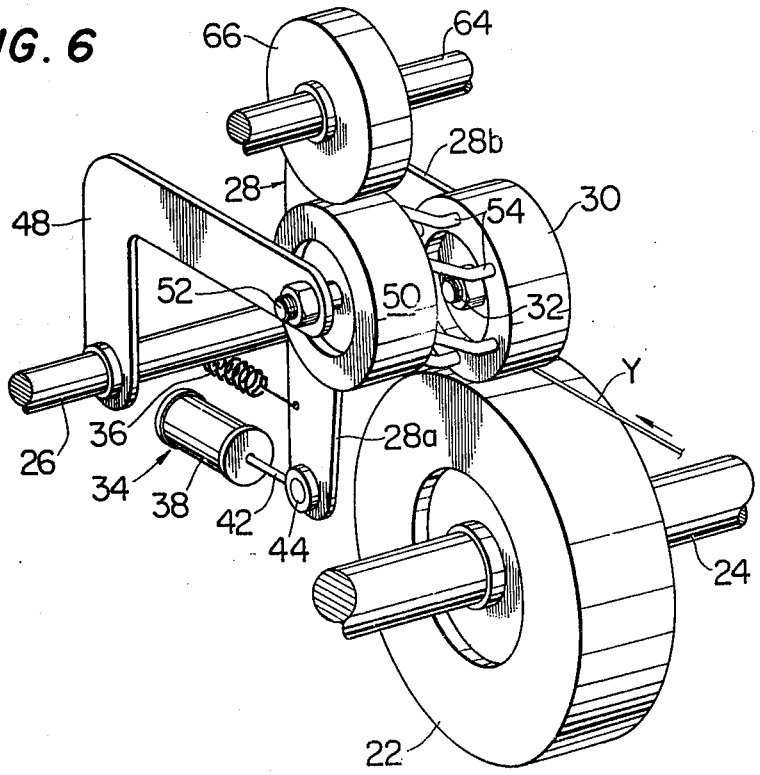
FIG. 6 is a perspective view which shows a third preferred embodiment of the yarn drawing and measuring device according to the present invention.

FIG. 6 illustrates a third preferred embodiment of the yarn drawing and measuring device according to the present invention. While the driving means for the pressing roller 30 in the first embodiment shown in FIGS. 1 to 3 or the second embodiment shown in FIGS. 4 and 5 is so arranged that the driving roller 50 is driven by the measuring roller 22 through direct engagement between the measuring and driving rollers 22 and 50 or by means of the belt and pulley arrangement 56, the third embodiment illustrated in FIG. 6 is distinguishable from the first and second embodiments in that the driving roller 50 forming part of the driving means for the pressing roller 30 is driven from an external driving source (not shown). The driving roller 50 in the embodiment shown in FIG. 6 is, therefore, also spaced apart from the measuring roller 22 as in the case of the embodiment illustrated in FIGS. 4 and 5. Above the driving roller 50 thus arranged is positioned a shaft 64 connected to the external driving source and extending substantially in parallel to the axis of rotation of the driving roller 50, viz., to the axis of the pivotal pin 52 through which the driving roller 50 is rotatably mounted on the stationary arm 48 secured at its foremost end to the stationary shaft 26. The shaft 64 thus extending over the driving roller 50 has fixedly mounted thereon a primary driving roller 66 which is rotatable about an axis of the shaft 64 and which is in rolling contact with the driving roller 50, herein called the secondary driving roller. The shaft 64 and the primary driving roller 66 are driven for rotation about an axis of the shaft 64 at an appropriate speed and in a direction similar to the direction of rotation of the measuring roller 22. The ratio between the diameters of the primary and secondary driving rollers 66 and 50 is determined depending upon the ratio between the diameters of the measuring and pressing rollers 30 and the revolution speeds of the shaft 24 and 64 for the purpose of enabling the pressing roller 30 to be rotated at a circumferential speed substantialy equal to the circumferential speed of the measuring roller 22. As in the case of the embodiment shown in FIGS. 4 and 5, the driving roller 50 may be positioned relative to the measuring roller 22 in such a manner as to have its axis of rotation aligned with the axis of rotation of the pressing roller 30 moved into the first relative position disengaged from the measuring roller 22 or to have its axis of rotation aligned with the axis of rotation of the pressing roller 30 moved into the second relative position contacting the measuring roller 22 as illustrated. The driving means for the pressing roller 30 of the embodiment shown in FIG. 6 is, thus, made up of the shaft 64, the primary and secondary driving rollers 64 and 50, the stationary arm 48, and the pliable connecting members 54.

Figure 7:
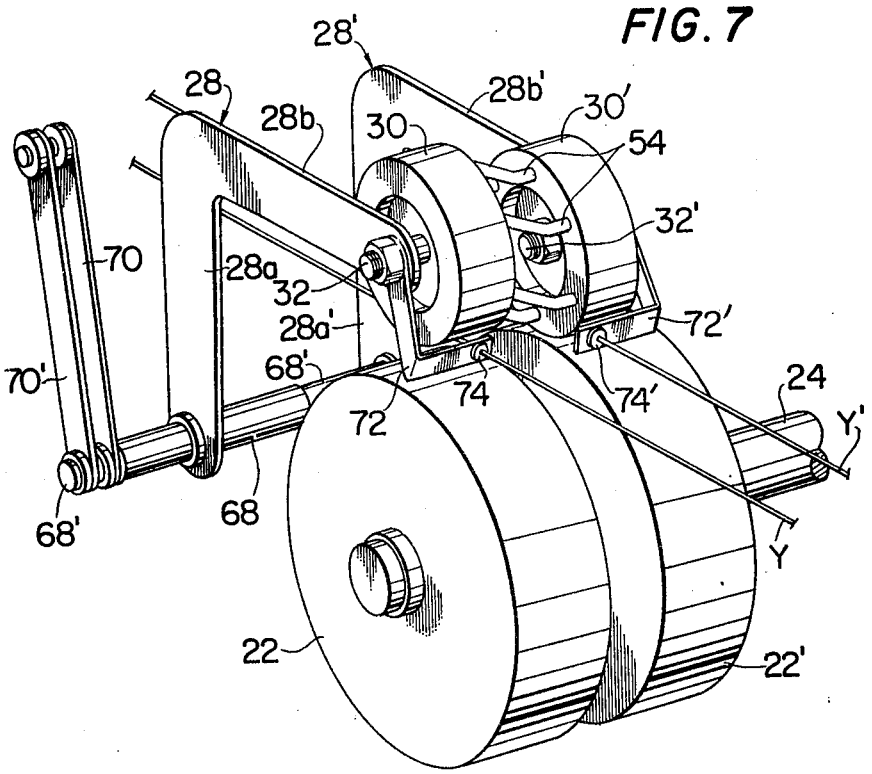
FIG. 7 is a perspective view showing a fourth preferred embodiment of the yarn drawing and measuring device according to the present invention.

FIG. 7 illustrates a fourth preferred embodiment of the yarn drawing and measuring device according to the present invention. While the embodiments thus far described have been assumed to include only one pressing roller and to be operable for the drawing off of only one weft yarn, the embodiment now illustrated in FIG. 7 comprises a pair of, first and second, pressing rollers 30 and 30' and a pair of, first and second, measuring rollers 22 and 22' which are respectively associated with the first and second pressing rollers 30 and 30' for selectively drawing and measuring two weft yarns Y and Y', fed from external yarn supply packages (not shown) independent from each other. The two measuring rollers 22 and 22' have substantially equal diameters and are secured to and thereby rotatable with a common shaft 24, which is driven for rotation at a speed matched with the operating speed of the weaving looms as previously mentioned. In parallel to the shaft 24 carrying the measuring rollers 22 and 22' are positioned an outer hollow shaft 68, and an inner shaft 68' which is partly coaxially received in the axial bore of the hollow shaft 68 and which has axial end portions projecting outwardly from the bore of the hollow shaft 68. The outer and inner shafts 68 and 68' are rotatable about their common axis and have fixedly carried thereon first and second bell-crank levers 28 and 28', respectively. The first bell-crank lever 28 has a lower arm portion **28*a* secured at its lower end to the outer hollow shaft 68 and an upper horizontal arm portion 28*b* emerging from the top end of the lower arm portion 28*a* and terminating above the top of the first measuring roller 22. Likewise, the second bell-crank lever 28' has a lower arm portion 28'*a* which is secured to one projecting axial end portion of the inner shaft 68', and an upper horizontal arm portion 28'*b* which emerges from the top end of the lower arm portion 28'*a* and which terminates above the top of the second measuring roller 22'. The first and second bell-crank levers 28 and 28' are thus rockable about the common axis of the shafts 68 and 68' independently of each other as the shafts 68 and 68' are driven for rotation about the common axis. The first bell-crank lever 28 has, carried at the leading or rearmost end of its upper horizontal arm portion 28*b*, the previously mentioned first pressing roller 30, mounted on this end by a pivotal end 32. Thus the pressing roller 30 is rotatable about an axis of the pivotal pin 32 and is rockingly movable between a first relative position disengaged or spaced upwardly from the top of the first measuring roller 22 and a second relative position in rolling contact with the top of the first measuring roller 22. Similarly, the second bell-crank lever 28' has, carried at the leading or rearmost end of its upper horizontal arm portion 28'*b*, the previously mentioned second pressing roller 30, mounted thereon by a pivotal pin 32'; thus the second pressing roller 30' is rotatable about an axis of the pivotal pin 32', and is rockingly movable between a first relative position disengaged or spaced upwardly from the top of the second measuring roller 22' and a second relative position in rolling contact with the top of the measuring roller 22'. The respective positions of the bell-crank levers 28 and 28' providing the first relative positions of the pressing rollers 30 and 30' will be herein referred to as first angular positions of the levers and, likewise, the positions of the bell-crank levers 28 and 28' respectively providing the second relative positions of the pressing rollers 30 and 30' will be referred to as second angular positions of the levers. The first and second bell-crank levers 28 and 28' are driven to move between their respective first and second angular positions by means of first and control levers 70 and 70', respectively. The first control lever 70 is fixedly connected at one end to the outer hollow shaft 68 and the second control lever 70' is fixedly connected at one end to the other projecting axial end portion of the inner shaft 68'. The two control levers 70 and 70' are connected each at the other end to suitable driving means (not shown) and are thereby driven to rotate the shafts 68 and 68'** about their common axis selectively and independently of each other. The driving means thus connected to the first and second control levers may be solenoid-operated cylinders or fluid-operated cylinders which are controlled by means of a pattern card arrangement of the nature previously described.

The first and second pressing rollers 30 and 30' are connected to each other by means of a plurality of pliable connecting members 54 which are secured to the mutually facing or inner side walls of the pressing rollers 30 and 30' in such a manner that they extend substantially in parallel to the axis of rotation of the rollers 30 and 30' when the rollers are moved into positions having their respective axes aligned with each other. When the pressing rollers 30 and 30' are moved relative to each other into positions having their axes offset from each other, the pliable connecting members 54 are elongated and deformed to follow the change in the relative positions of the rollers as seen in FIG. 7. Designated by reference numerals 72 and 72' are yarn guide members which are fixedly secured to the pivotal pins 32 and 32' on the first and second bell-crank levers 28 and 28'. The yarn guide members 72 and 72' are formed with apertures 74 and 74', respectively, which are located in the paths of the weft yarns Y and Y' over the measuring rollers 22 and 22' and through which the weft yarns Y and Y' are fed to the tops of the measuring rollers 22 and 22', respectively.

During operation, the first and second pressing rollers 30 and 30' are selectively or alternately actuated into rolling contact with the respectively associated measuring rollers 22 and 22' in accordance with predetermined schedules which are set on the pattern card dictating the motions of the control levers 70 and 70'. When one of the first and second pressing rollers 30 and 30' is moved into the first relative position disengaged from the associated measuring roller 22 or 22', the other of the pressing rollers 30 and 30' is moved into the second relative position in rolling contact with the measuring roller 22' or 22 associated therewith. If, in this instance, the first control lever 70 is driven to rotate the outer hollow shaft 68 for causing the first bell-crank lever 28 into the first angular position thereof so that the first pressing roller 30 is moved into the first relative position disengaged from the first measuring roller 22 and, at the same time the second control lever 70' is driven to rotate the inner shaft 68' for causing the second bell-crank lever 28' into the second angular position thereof so that the second pressing roller 30' is moved into the second relative position rolling on the second measuring roller 22' as seen in FIG. 7, then the second pressing roller 30' is driven by the second measuring roller 22' through the rolling contact between the second measuring and pressing rollers 22' and 30' and thus drives the first pressing roller 30 through the pliable connecting members 54 which are in deformed conditions. The first pressing roller 30 is in this manner kept rotating or idling over the first measuring roller 22 while the weft yarn Y' is being drawn off by the second measuring and pressing rollers 22' and 30'. The circumferential speed at which the first pressing roller 30 is driven by the second pressing roller 30' is substantially equal to the circumferential speed of rotation of the first measuring roller 22 because of the fact that the first and second measuring rollers 22 and 22' have substantially equal diameters and the first and second pressing rollers 30 and 30' also have substantially equal diameters. When, conversely, the first pressing roller 30 is moved into the second relative position rolling on the first measuring roller 22 and at the same time the second pressing roller 30' is moved into the first relative position disengaged from the second measuring roller 22', then the first pressing roller 30 is driven by the first measuring roller 22 through the rolling contact between the first pressing and measuring rollers 22 and 30 and thus drives the second pressing roller 30' through the pliable connecting members 54. The second pressing roller 30' is consequently kept rotating above the second measuring roller 22' while the weft yarn Y is being drawn off by the first measuring and pressing rollers 22 and 30. The circumferential speed at which the second pressing roller 30' is driven by the first pressing roller 30 is substantially equal to the circumferential speed of rotation of the second measuring roller 22' for the same reason as previously explained. The fourth embodiment of the yarn drawing and measuring device according to the present invention is, thus, characterized in that, while one of the pressing rollers 30 and 30' is in rolling contact with the associated measuring roller 22 or 22' during one measuring cycle, the other pressing roller is kept driven to rotate at a circumferential speed substantially equal to the circumferential speed of the measuring roller associated therewith throughout the measuring cycle. When the pressing roller which has been held in the first relative position disengaged from the associated measuring roller is then moved into the second relative position contacting the associated measuring roller, the pressing roller is kept rotating at a speed approximating or practically equal to the circumferential speed of rotation of the measuring roller with which the pressing roller is to be brought into rolling contact. The pressing roller brought into rolling contact with the associated measuring roller is, in this manner, kept driven to rotate at a circumferential speed substantially completely matched with the circumferential speed of rotation of the measuring roller even at an incipient stage of contact between the associated measuring and pressing rollers. The embodiment shown in FIG. 7 is thus characterized, more briefly, in that one of the pressing rollers 30 and 30' acts as a driving roller for the other while the former is driven by the measuring roller associated therewith for drawing off one of the weft yarns. In the embodiment shown in FIG. 7, therefore, the combination of each bell-crank lever, the shaft carrying it and the respective control lever associated with the respective pressing roller for placing that roller in rolling contact with the associated measuring roller constitutes positioning means for the respective pressing roller; and the combination of the other pressing roller, the pliable connecting members and the bell-crank lever, associated with the other pressing roller shaft and control lever constitute driving means for the former pressing roller, in each of the corresponding measuring cycles.

Figure 8:
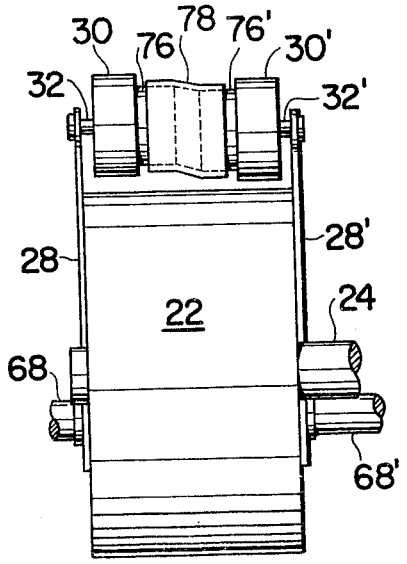
FIG. 8 is a rear end view of a fifth preferred embodiment of the yarn drawing and measuring device according to the present invention.

FIG. 8 illustrates a fifth preferred embodiment of the yarn drawing and measuring device according to the present invention. The embodiment herein shown is a modified version of the embodiment thus far described with reference to FIG. 7. While two measuring rollers 22 and 22′ are provided in association with the two pressing rollers 30 and 30′, respectively, in the embodiment shown in FIG. 7, only one measuring roller, designated by reference numeral 22, is provided commonly to the first and second pressing rollers 30 and 30′ in the embodiment illustrated in FIG. 8. The first and second pressing rollers 30 and 30′ of the embodiment shown in FIG. 8 are, furthermore, formed with or fixedly secured thereto, generally cylindrical lands 76 and 76′, respectively, axially projecting from the respective inner side faces of the pressing rollers. A pliable connecting member 78 of a tubular form is securely received at its opposite axial end portions on the peripheral surfaces of these cylindrical lands 76 and 76′ of the pressing rollers 30 and 30′ in such a manner that the pliable tubular connecting member 78 has a substantially straight axis in line with the axes of rotation of the pressing rollers 30 and 30′ when the two pressing rollers are moved into relative positions having their respective axes brought into alignment with each other. The pliable tubular connecting member 78 is thus elastically deformed mainly in its axially intermediate portion as the first and second pressing rollers 30 and 30′ are moved to each other while having their respective axes in parallel to the axis of rotation of the measuring roller 22 as illustrated. Driving connection is, in this manner, provided alternatley from one of the first and second pressing rollers 30 and 30′ to the other through the deformed pliable tubular connecting member 78 when the former is in rolling contact with the measuring roller 22 and at the same time the latter is in a condition disengaged from the measuring roller 22. The pliable tubular connecting member 78 is formed, for example, of urethane rubber. The embodiment shown in FIG. 8 is, in other respects, similar to the embodiment shown in FIG. 7 and, as such, other constructional features of the latter will be self-explanatory from the description made in connection with the latter.

Figure 9:
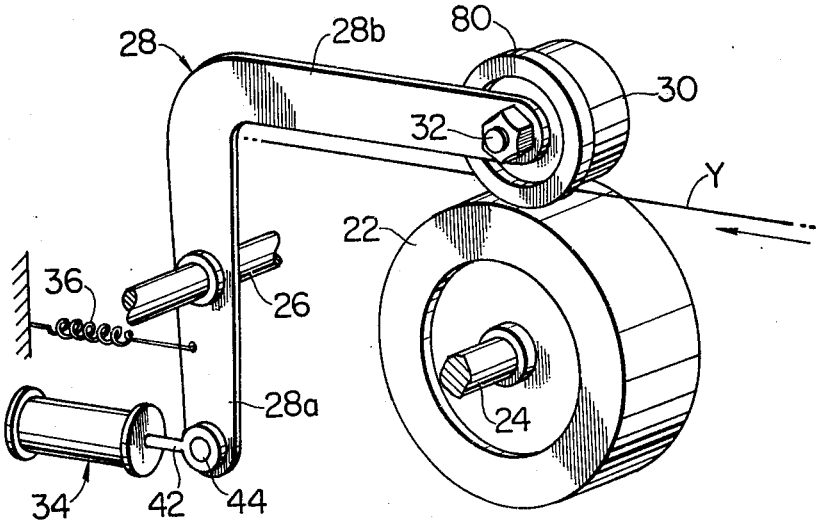
FIG. 9 is a perspective view which shows a sixth preferred embodiment of the yarn drawing and measuring device according to the present invention.

FIG. 9 illustrates a sixth preferred embodiment of the yarn drawing and measuring device according to the present invention. The embodiment herein shown is characterized by driving means for the pressing roller 30. The driving means comprises a driving roller or disc 80 which is fixedly attached to one axial end face of the pressing roller 30 and which is thus rotatable on the pivotal shaft 32 through which the pressing roller 30 is rotatably mounted on the upper horizontal arm portion 28*b* of the bell-crank lever 28. The bell-crank 28 has its lower arm portion 28*a* pivotally supported by the stationary shaft 26 and is driven between first and second angular positions by means of the solenoid-operated cylinder 34 and the tension spring 36 as previously mentioned in respect of the first embodiment shown in FIGS. 1 to 3.

The driving roller or disc 80 is formed with an elastic material such as for example urethane rubber and has a diameter larger than the diameter of the pressing roller 30. Thus, the driving roller or disc 80 has a circumferential portion which projects radially outwardly from the circumferential edge of the pressing roller 30 juxtaposed therewith and which is held in rolling contact with the top end of the measuring roller 22 on the shaft 24 irrespective of the relative angular position of the bell-crank lever 28 carrying the driving roller or disc 80. More specifically, the driving roller or disc 80 is held in rolling contact with the measuring roller 22 while maintaining its initial disc-shaped configuration when the bell-crank lever 28 is in its first angular position holding the pressing roller 30 in a first relative position disengaged from the measuring roller 22, as illustrated in FIG. 9. When, however, the bell-crank lever 28 is driven to rotate about the stationary shaft 26 into the second angular position thereof and accordingly the pressing roller 30 is brought into a second relative position rolling on the measuring roller 22, the driving roller or disc 80 is tightly pressed at its lower end portion onto the top end portion of the measuring roller 22 and, as a consequence, has the lower end portion elastically deformed while continueing to roll on the measuring roller 22. The diameter of the driving roller or disc 80 should therefore be selected in such a manner as to enable the driving roller or disc 80 to be in rolling contact in a slackened or locally undeformed condition with the measuring roller 22 when the pressing roller 30 is in its first relative position disengaged from the measuring roller 22 and to permit the pressing roller 30 to reach its second relative position contacting the top end of the measuring roller 22 when the driving roller or disc 80 is tightly pressed against the measuring roller 22 and deformed at its lower end portion. Since the pressing roller 30 is usually moved only an appreciable distance between the first and second relative positions thereof, the diameter of the driving roller or disc 80 may be only slightly larger than the diameter of the pressing roller 30. The circumferential speed of rotation of the pressing roller 30 is, for this reason, practically equal to the circumferential speed of rotation of the driving roller or disc 80 and accordingly to the circumferential speed of rotation of the measuring roller 22 especially when the driving roller or disc 80 is rolling on the measuring roller 22 in a locally deformed condition in which the radius of the deformed portion is substantially equalized with the radius of the pressing roller 30. While the driving roller or disc 80 has been described as being mounted on the pressing roller 30, the same may be mounted on and rotatable with the measuring roller 22, if desired. In this instance, the driving roller or disc attached to the measuring roller has a diameter appreciably larger than the diameter of the measuring roller and is constantly held in driving engagement with the pressing roller so that the pressing roller is permitted to contact the measuring roller with the driving roller or disc elastically deformed at its upper end portion forcibly pressed against the pressing roller during a measuring cycle.

Figure 10:
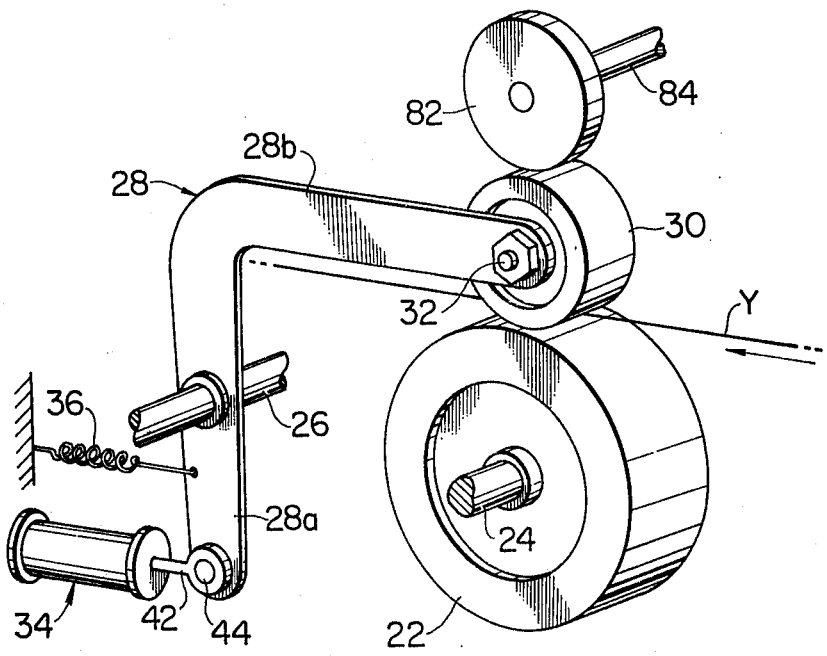
FIG. 10 is a perspective view showing a seventh preferred embodiment of the yarn drawing and measuring device according to the present invention.

FIG. 10 illustrates a seventh preferred embodiment of the yarn drawing and measuring device according to the present invention. The embodiment herein shown is a modification of the embodiment illustrated in FIG. 9. While the pressing roller 30 is driven by the measuring roller 22 through rolling contact between the measuring and pressing rollers 22 and 30 in the embodiment illustrated in FIG. 9, the embodiment shown in FIG. 10 is characterized in that the pressing roller 30 is driven from an external driving source when disengaged from the measuring roller 22, similarly to the embodiment previously described with reference to FIG. 6. Referring to FIG. 10, there is provided a driving roller or disc 82 which is formed of an elastic material such as urethane rubber. The driving roller or disc 82 is constantly in rolling contact with the pressing roller 30 and is rotatable with a shaft 84 extending substantially in parallel to the axes of rotation of the measuring and pressing rollers 22 and 30. The shaft 84 is connected to an external driving source (not shown) and is driven to rotate about its axis throughout the operation of the weaving loom at an appropriate speed and in a direction similar to the direction of rotation of the measuring roller 22. The driving roller or disc 82 is arranged (viz., positioned and sized) in such a manner as to be in rolling contact in a locally elastically deformed condition on the pressing roller 30 when the pressing roller 30 is in a first relative position disengaged from the measuring roller 22 and tightly forced against the driving roller or disc 82 and to be in rolling contact in a normal disc-shaped or undeformed configuration on the pressing roller 30 when the pressing roller 30 is in a second relative position rolling on the measuring roller 22 in a measuring cycle of the yarn drawing and measuring device. The diameter and the modulus of elasticity of the driving roller or disc should be selected in consideration of the ratio between the speeds of rotation of the shafts 24 and 84 and the ratio between the diameters of the measuring and pressing rollers 22 and 30 so that the driving roller or disc 82 is capable of driving the pressing roller 30 for rotation at a circumferential speed which is substantially equal to the circumferential speed of the measuring roller 22 especially when the pressing roller 30 is brought into rolling contact with the measuring roller 22 with the driving roller or disc 82 in a normal or undeformed condition. The driving means for the pressing roller 30 in the embodiment shown in FIG. 10 is thus constituted by the driving roller or disc 82 and the shaft 84 carrying the driving roller or disc 82.

Figure 11:
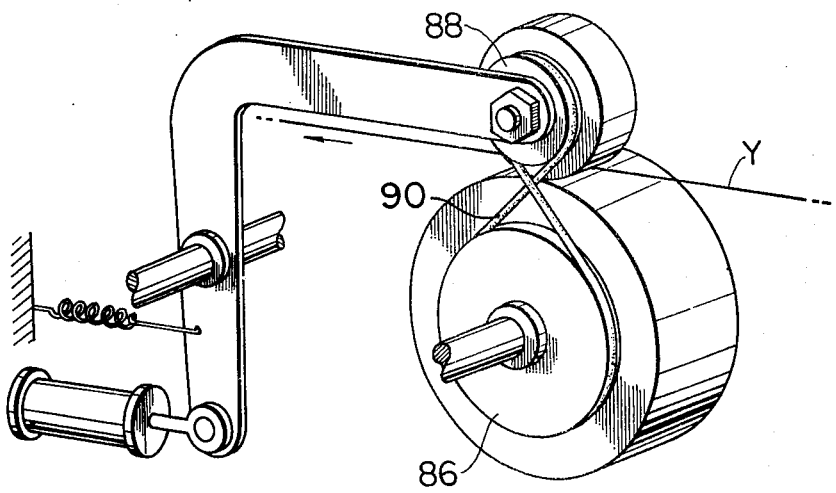
FIG. 11 is a perspective view showing an eighth preferred embodiment of the yarn drawing and measuring device according to the present invention.

FIG. 11 illustrates an eighth preferred embodiment of the yarn drawing and measuring device according to the present invention. While the yarn drawing and measuring device embodying the present invention has been described as using a plurality of elongate pliable connecting members or a single pliable connecting member of a tubular form or a deformable driving roller or disc, the embodiment illustrated in FIG. 11 is characterized by the provision of a belt and pulley arrangement yieldable to the movement of the pressing roller. Referring to FIG. 11 such a belt and pulley arrangement comprises a driving pulley 86 which is fixedly at attached to or integrally formed on one side face of the measuring roller 22 and which is thus rotatable about the axis of the shaft 24 together with the measuring roller 22 and a driven pulley 88 which is fixedly attached to or integrally formed on a side face of the pressing roller 30 and which is thus rotatable about the axis of the pivotal pin 32 together with the pressing roller 30. The belt and pulley arrangement further comprises an elastically stretchable endless belting 90 of an elastic material. The endless belting 90 is passed on the driving and driven pullys 86 and 88 intermediately crossing relation so that the driven pulley 88 and driven for rotation about its axis by the driving pulley 86 in a direction opposite direction to the direction of rotation of the driving pulley 86. The endless belting 90 has a predetermined normal length when subjected to a normal tension and is stretchable from the normal length when an additional tension is applied to the belting. More specifically, the endless belting 90 is stretched from the normal length when the pressing roller 30 carrying the driven pulley 88 is moved into a first relative position disengaged from the measuring roller 22 carrying the driving pulley 86. The endless belting 90 resumes the normal length when the pressing roller 30 is moved from the first relative position into a second relative position contacting the measuring roller 22. In whichsoever condition the endless belting 90 is maintained, the belting 90 is operative to transmit a driving force from the driving pulley 86 to the driven pulley 88 provided the driving pulley 86 is being driven so that the pressing roller 30 is kept driven throughout the operation of the loom. The ratio between the diameters of the driving and driven pulleys 86 and 88 should be so selected that the resultant circumferential speed of rotation of the pressing roller 30 substantially equals the circumferential speed of rotation of the measuring roller 22.

FIGS. 12 to 15 illustrate a ninth preferred embodiment of the yarn drawing and measuring device according to the present invention. While every one of the embodiments thus far described with reference to FIGS. 1 to 11 uses elastically deformable torque transmission means for the driving of the pressing roller or rollers, the embodiment shown in FIGS. 12 to 15 is characterized by provision of self-adjustable torque transmission means including rigid engaging members which are movable relative to each other responsive to change in the relative position of the pressing roller to the measuring roller. Except for such self-adjustable torque transmission means, the embodiment shown in FIGS. 12 to 15 is similar in constuction to the embodiment illustrated in FIGS. 1 to 3 and, thus, includes a driving roller 50 which is rotatably carried on a stationary arm 48 through a pivotal pin 52. As previously described with reference to FIGS. 1 to 3, the pressing roller 30 is rotatably carried by a bell-crank lever 28 through a pivotal pin 32 and the bell-crank lever 28 is, in turn, rockably supported by the stationary shaft 26. The pressing roller 30 is movable between a first relative position disengaged from a measuring roller 22 on a driven shaft 24 and a second relative position contacting the top end of the measuring roller 22 by rotational movement of the bell-crank lever 28 between first and second angular positions about the axis of the stationary shaft 26. The movement of the bell-crank lever 28 between the first and second angular positions is effected by driving means which may include a solenoid-operated cylinder 34 and resilient biasing means which may include a tension spring (which is not shown in FIGS. 12 to 15 but which corresponds to the tension spring 36 shown in FIG. 1). The driving roller 50 is constantly in rolling engagement with the top end of the measuring roller 22 which is driven at a speed proportional or otherwise related to the operating speed of the weaving loom. The driving roller 50 is thus driven for rotation about its axis at a circumferential speed substantially equal to the circumferential speed of rotation of the measuring roller 22 through the driving engagement from the measuring roller 22 to the driving roller 50. The pressing roller 30 has a diameter equal to the diameter of the driving roller 50 and is thus rotatable at a circumferential speed substantially equal to the circumferential speed of the rotation of the measuring roller 22.

The pressing roller 30 is integrally formed with or fixedly secured thereto a projection 92 which projects substantially in parallel to the axis of rotation of the pressing roller 30 from the inner side face of the pressing roller toward the opposite side face of the driving roller 50 which is positioned sideways of the pressing roller 30. The projection 92 is preferably located in the vicinity of the circumferential edge of the side face of the pressing roller 30. In correspondence with the projection 92 thus provided on the pressing roller 30, the driving roller 50 is integrally formed with or fixedly secured thereto a pair of spaced parallel projections 94 and 94' which project substantially in parallel to the axis of rotation of the driving roller 50 from the inner side face of the driving roller 50 toward the opposite side face of the pressing roller 30. The spaced parallel projections 94 and 94' on the driving roller 50 are equidistantly spaced apart from a diametrical center line of the circular side face of the driving roller 50 as will be best seen from FIG. 15 and are located relative to the circumferential edge of the side face of the driving roller 50 so as to correspond to the location of the projection 92 relative to the circumferential edge of the inner side face of the pressing roller 30, as will be seen from FIGS. 14 and 15. The pressing and driving rollers 30 and 50 are positioned relative to each other with the projection 92 on the pressing roller 30 movably received between the spaced parallel projections 94 and 94' on the driving roller 50 as will be seen from FIG. 12 or 13. The distance between the projections 94 and 94' and the lengths thereof should be so selected as to permit the projection 92 to be movable, without being deformed and without the risk of being disengaged from the projections 94 and 94', between and along the projections 94 and 94' when the pressing roller 30 is moved relative to the driving roller 50, viz., between the first and second relative positions thereof relative to the measuring roller 22, as will be seen from FIG. 13.

Figure 14:
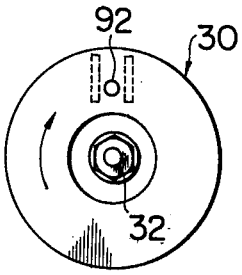
FIG. 14 is a plan view of an inner side face of the pressing roller of the embodiment shown in FIGS. 12 and 13.
Figure 15:
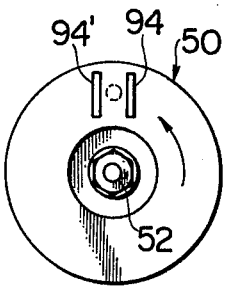
FIG. 15 is a plan view of an inner side face of the driving roller of the embodiment shown in FIGS. 12 and 13.

When, in operation, the bell-crank lever 28 is in the first angular position thereof with the solenoid-operated cylinder 34 energized under the control of the pattern card arrangement, the pressing roller 30 is held in its first relative position disengaged or spaced upwardly from the top end of the measuring roller 22. The pressing roller 30 is thus slightly raised from the initial position having its axis of rotation aligned with the axis of rotation of the driving roller 50 so that, if the projection 92 on the pressing roller 30 and the projections 94 and 94' on the driving roller 50 happen to be located at their highest positions as indicated in FIGS. 14 and 15 and provided the pressing roller 30 is being rotated clockwise of FIG. 14 with the driving roller 50 driven by the measuring roller 22 to rotate counter-clockwise of FIG. 15, then the projection 92 on the pressing roller 30 will be in abutting engagement with a radially outer end portion of the projection 94 which is located on a tailing side of the projection 92, as will be understood from the illustration in phantom lines of FIG. 13. As the pressing and driving rollers 30 and 50 are rotated clockwise and counter-clockwise of FIGS. 14 and 15, respectively, from the above mentioned angular positions, the projection 92 on the pressing roller 30 is caused to slide radially inwardly on the inner side face of the tailing projection 94 on the driving roller 50. The projection 92 is thus in contact with an intermediate portion of the inner side face of the tailing projection 94 when the pressing and driving rollers 30 and 50 have turned about 90° from the angular positions having the projections in the highest position shown in FIGS. 14 and 15. As the pressing and driving rollers 30 and 50 are further rotated, the projection 92 on the pressing roller 30 will be moved radially inwardly relative to the center of the side face of the driving roller 50 and will be in contact with a radially inner end portion of the projection 94 on the driving roller 50 when the pressing and driving rollers 30 and 50 have turned into angular positions having the projections 92, 94 and 94' in the lowest positions. The projection 92 will be then gradually moved relative to the side face of the driving roller 50 toward the projection 94' on the leading side of the projection 92 and, simultaneously toward a radially outer end portion of the leading projection 94' as the pressing and driving rollers 30 and 50 are further rotated clockwise and counterclockwise of FIGS. 14 and 15, respectively, toward the initial angular positions shown in FIGS. 14 and 15.

The projection 92 on the pressing roller 30 is, in this manner, maintained in abutting and sliding engagement with either of the spaced parallel projection 94 or 94' on the driving roller 50 depending upon the angular position of the projection 92 relative to the side face of the driving roller 50 when the pressing roller 30 is held in its first relative position disengaged from the measuring roller 22. The pressing roller 30 is thus kept driven by the driving roller 50 through the engagement maintained between the projection on the former and the projection 94 or 94' on the latter even though the pressing roller 30 has its axis of rotation off set from the axis of rotation of the driving roller 50.

Figure 12:
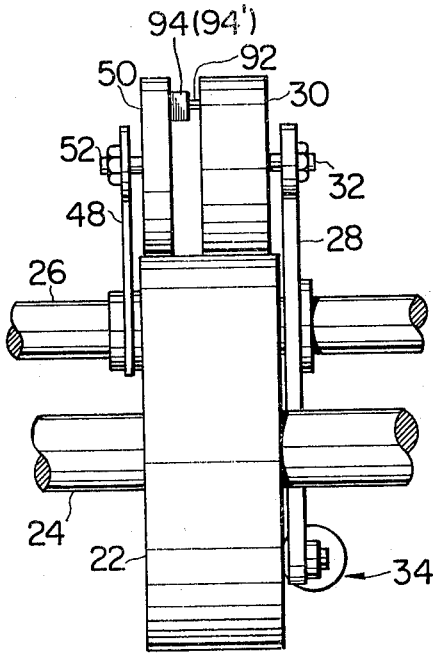
FIG. 12 is an end view of a ninth preferred embodiment of the yarn drawing and measuring device according to the present invention, the device being viewed forward from the rear of the device.
Figure 13:
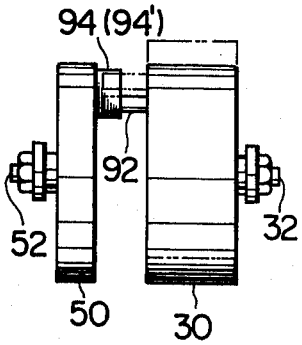
FIG. 13 is an end view of pressing and driving rollers, in different relative positions, forming part of the yarn drawing and measuring device illustrated in FIG. 12.

When the bell-crank lever 28 is driven from the first angular position into the second angular position by means of a biasing force applied thereto with the solenoid-operated cylinder 34 de-energized under the control of the pattern-card arrangement, the pressing roller 30 is moved into the second relative position contacting the top end of the measuring roller 22 and having its axis of rotation in alignment with the axis of rotation of the driving roller 50 as seen in FIG. 12. The projection 92 on the pressing roller 30 is consequently maintained in abutting engagement with the inner side face of the tailing-side projection 94 on the driving roller so that the pressing roller 30 is driven for rotation by the driving roller 50 while rolling on the measuring roller 22.

It will be apparent that, in lieu of the arrangement of the projections provided on the embodiment thus far described, the spaced parallel projections 94 and 94' may be formed or mounted on the inner side face of the driving roller 50 so that the projection to be movably received between the projections 94 and 94' is formed or mounted on the inner side face of the driving roller 50, where desired.

Figure 16:
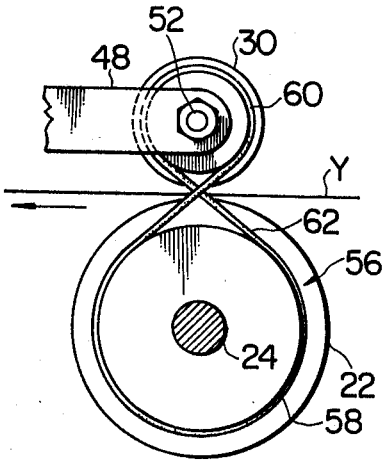
FIG. 16 is a side elevational view showing essential part of a tenth preferred embodiment of the yarn drawing and measuring device according to the present invention.
Figure 17:
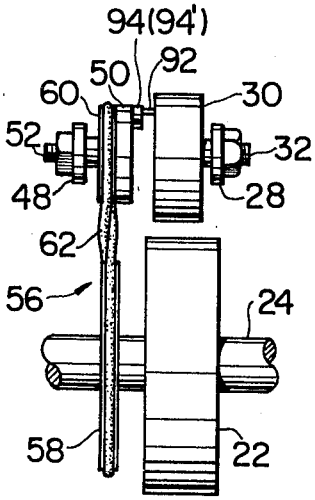
FIG. 17 is a rear end view of the yarn drawing and measuring device shown in FIG. 16.

FIGS. 16 and 17 illustrate a tenth preferred embodiment of the yarn drawing and measuring device according to the present invention. The embodiment herein shown is a modification of the ninth embodiment shown in FIGS. 12 to 15 and is characterized by the provision of a belt and pulley arrangement by which the driving roller is driven by the shaft driving the measuring roller. The belt and pulley arrangement is entirely similar to the belt and pulley arrangement incorporated in the embodiment illustrated in FIGS. 4 and 5 and is, thus, designated in its entirety by reference numeral 56. The belt and pulley arrangement 56 includes a driving pulley 58 rotatable with the shaft 24 carrying the measuring roller 22 and a driven pulley 58 rotatable with the pivotal pin 52 carrying the driving roller 50. An endless belting 62 is passed on the driving and driven pulleys 58 and 60 in intermediately crossing relation so that the driving pulley 58 driven by the shaft 24 carrying the measuring roller 22 drives the driven pulley 58 for rotation about the axis of the pin 52 in a direction opposite to the direction of rotation of the driving pulley 58. The ratio between the diameters of the driving and driven pulleys 58 and 60 should be selected in such a manner that the driven pulley 60 is capable of driving the driving roller 50 for rotation at a speed which will enable the pressing roller 30 to rotate at a circumferential speed substantially equal to the circumferential speed of rotation of the measuring roller 22. The driving pulley 58 may be fixedly attached or integrally formed on the measuring roller 22 and, likewise, the driven pulley 60 may be fixedly attached to or integrally formed on the driving roller 50, where desired. The operation of the yarn drawing and measuring device above described is essentially similar to that of the device illustrated in FIGS. 12 to 15 and, thus, description thereof will not be herein repeated.

Figure 18:
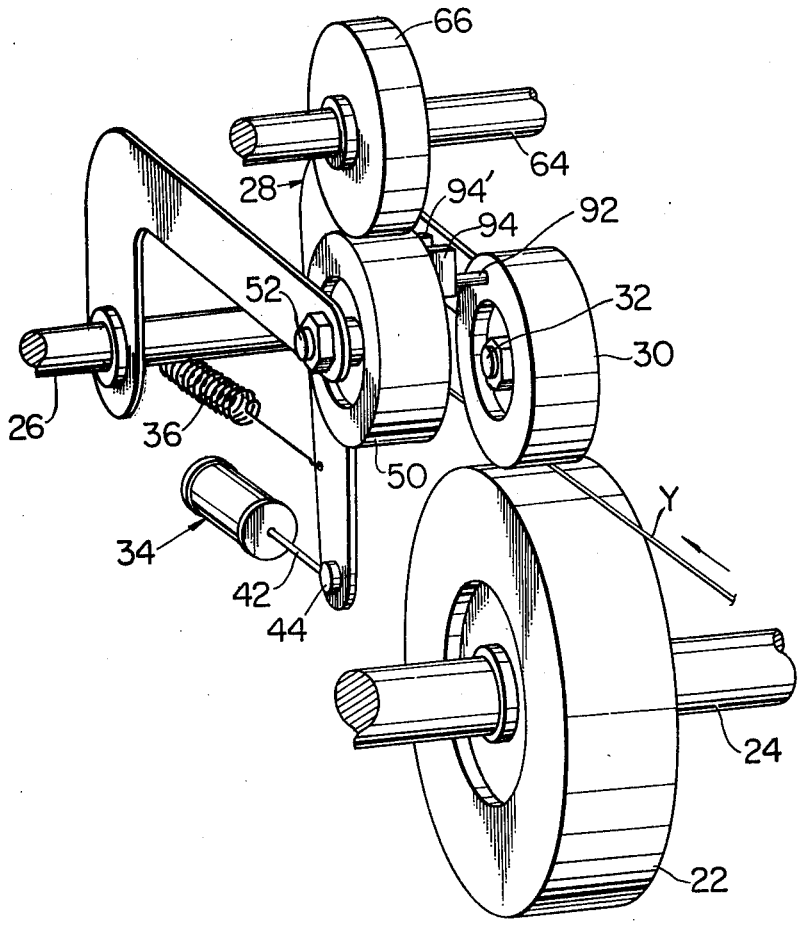
FIG. 18 is a perspective view which shows an eleventh preferred embodiment of the yarn drawing and measuring device according to the present invention.

FIG. 18 illustrates an eleventh preferred embodimet of the yarn drawing and measuring device according to the present invention. The embodiment herein shown is another modification of the embodiment described with reference to FIGS. 12 to 15 and, as such, includes a pressing roller 30 provided with a projection 92 and a driving roller 50 provided with spaced parallel projections 94 and 94' and engaging the projection 92 on the pressing roller 30. The eleventh embodiment of the device according to the present invention is characterized by a driving arrangement through which the driving roller 50 is driven from an external driving source, as in the case of the embodiment previously described with reference to FIG. 6. Members constituting the driving arrangement for the driving roller 50 are, therefore, designated in FIG. 18 by the same reference numerals as those used in FIG. 6.

Referring to FIG. 18, the driving arrangement for the driving roller 50 consists of a shaft 64 drivent by an external driving source (not shown) and extending over the driving roller 50 substantially in parallel to the axes of rotation of the measuring, pressing and driving rollers 22, 30 and 50, and a primary driving roller 66 which is fixedly carried on the shaft 64 and which is in rolling engagement with the driving roller 50 herein referred to as the secondary driving roller. The diameter of the primary driving roller 66 should be selected in consideration of the ratio between the speeds of rotation of the shafts 24 and 64 and the ratio between the diameters of the measuring and pressing rollers 22 and 30 so that the pressing roller 30 is driven for rotation at a circumferential speed substantially equal to the circumferential speed of rotation of the measuring roller 22. Where the secondary driving roller 50 has a diameter substantially equal to the diameter of the pressing roller 30 as previously mentioned, the diameter of the primary driving roller 66 should be so selected that the circumferential speed of rotation of the primary driving roller 66 equals the circumferential speed of rotation of the measuring roller 22 because the secondary driving roller 50 rotating with the pressing roller 30 has a circumferential speed equal to that of the primary driving roller 66 rolling on the secondary driving roller 50.

FIGS. 19 and 20 illustrate a twelfth preferred embodiment of the yarn drawing and measuring device according to the present invention. While each of the embodiments thus far described with reference to FIGS. 12 to 18 is characterized mainly in that the pressing and driving rollers 30 and 50 are engaged by each other through abutting engagement between the projections formed or mounted on the rollers, the embodiment now illustrated in FIGS. 19 and 20 features an articulated belt and pulley or sheave arrangement providing a driving connection from an external driving source to the pressing roller and having an allowance for the displacement of the pressing roller into and out of rolling contact with the measuring roller. Referring to FIGS. 19 and 20, the pressing roller 30 is supported by a bell-crank lever 28 which is rockable between first and second angular positions about the shaft 26 which extends substantially in parallel to the stationary shaft 24 carrying the measuring roller 22. The bell-crank lever 28 has the lower arm portion **28*a* connected to the leading end of the plunger 42 of the solenoid-operated cylinder 34 through the pivotal pin 44 and to the tension spring 36. The upper horizontal arm portion 28*b* of the bell-crank lever 28 terminates over the top end of the measuring roller 22 and carries at the leading end thereof the pressing roller 30 through the pivotal pin 32, similarly to the arrangement shown in FIGS. 1 to 3.**

In the embodiment shown in FIGS. 19 and 20 is further provided an articulated belt and pulley or sheave arrangement which includes a single-grooved driving pulley 96 rotatable with a shaft 98 extending in parallel to the shafts 24 and 26 and connected to a driving source 100. A dual-grooved intermediate pulley 102 is rotatably carried by the stationary shaft 26 and is positioned in line with the driving pulley 96. A first endless belting 106 is passed on the driving and intermediate pulleys 96 and 102 so that the intermediate pulley 102 is driven for rotation about the axis of the stationary shaft 26 clockwise of FIG. 19 when the driving pulley 96 is driven by the driving source 100 through the shaft 98. The relative positions of the two pulleys 96 and 102 to each other are fixed and unchanged throughout the operation of the yarn drawing and measuring device. The articulated belt and pulley arrangement further comprises a single-grooved pulley 104 which is rotatable with pivotal pin 32 carrying the pressing roller 30 and which is positioned substantially in line with the intermediate pulley 102. The driven pulley 104 is shown as being fixedly secured to or integrally formed on one side face of the pressing roller 30. A second endless belting 108 is passed on the intermediate and driven pulleys 102 and 104 so that the driven pulley 104 is driven for rotation about the pin 32 clockwise of FIG. 19, viz., in a direction opposite to the direction of rotation of the measuring roller 22. The dual-grooved intermediate pulley 102 thus receives the first endless belting in one of its circumferential grooves and the second endless belting in the other of the circumferential grooves as will be seen in FIG. 20. A driving connection is in this manner provided from the driving source 100 to the pressing roller 30 through the shaft 98 connected to the driving source 100, the driving pulley 96 carried on the shaft 98, the first endless belting 106, the intermediate pulley 102 rotatable on the stationary shaft 26, the second endless belting 108, and the driven pulley 104 on the pivotal pin 32 journaled to the upper horizontal arm portion **28*b* of the bell-crank lever 28.**

When, now, the bell-crank lever 28 is driven into the first angular position with the solenoid-operated cylinder 34 energized under the control of the pattern card arrangement incorporated into the weaving loom, the pressing roller 30 and the driven pulley 104 are caused to rotate a small angle about the axis of the stationary shaft 26 so that the pressing roller 30 is moved into a first relative position disengaged or upwardly spaced apart from the top end of the measuring roller 22 and at the same time the second endless belting 108 is in its entirety slightly turned counter-clockwise of FIG. 19 about the axis of the stationary shaft 26, viz., in unison with the upper horizontal arm portion 28*b* of the bell-crank lever 28. The second endless belting 108 is, however, still driven by the intermediate pulley 102 and thus remains operative to drive the driven pulley 104. The pressing roller 20 is accordingly kept rotating or idling over the measuring roller 22. When the bell-crank lever 28 is thereafter driven into the second angular position thereby the biasing force of the tension spring 36 with the solenoid-operated cylinder 34 de-energized under the control of the pattern card arrangement, the pressing roller 30 is moved into a second relative position and is brought into rolling contact with the measuring roller 22 as shown in FIG. 19. Under these conditions, the second endless belting 108 is, in its entirety, turned clockwise of FIG. 19 about the axis of the stationary shaft 26 and continues to transmit the driving force from the intermediate pulley 102 to the driven pulley 104. The ratio among the diameters of the driving, intermediate and driven pulleys 96, 102 and 104 should be selected in consideration of the ratio between the speeds of rotation of the shafts 24 and 98 and the ratio between the diameters of the measuring and pressing rollers 22 and 30 so that the pressing roller 30 is driven for rotation at a circumferential speed which is substantially equal to the circumferential speed of rotation of the measuring roller 22 in whichsoever relative position the pressing roller 30 may be held. The embodiment thus far described with reference to FIGS. 19 and 20 is, thus, characterized in that allowance of the driving means for following the movement of the pressing roller 30 is provided by the angular movement of the combination of the second endless belting 108 and the driven pulley 104 about the axis of rotation of the intermediate pulley 102.

From the foregoing description it will now be appreciated that the yarn drawing and measuring device embodying the present invention is useful for the fabrication of uniformly woven fabrics with high quality because the pressing roller is kept rotating throughout the operation of the drawing and measuring device and at all times driven for rotation at a circumferential speed substantially matched with the circumferential speed of rotation of the measuring roller so that the yarn gripped between the pressing and measuring rollers during measuring and drawing cycles is prevented from being subjected to objectional slippage or braking force that would otherwise cause a shortening of the measured-off length of the yarn or the cutting of the yarn or the rupture of the filaments constituting the yarn. Because, moreover, the weft yarn to be measured and drawn off by the yarn drawing and measuring device according to the present invention is at all times received on the measuring roller, the troublesome and time-consuming operation to insert the yarn end in between the pressing and measuring rollers can be completely dispensed with. The embodiments of the device according to the invention using the belt and pulley arrangements are distinct over the prior art devices using gear arrangement in that no such means as to lubricate the gears is necessitated in achieving the rotation of the pulleys at extremely high speeds so that there is no risk of the resultant fabrics being contaminated with a lubricant.

In conclusion, it is pointed out that, while a variety of embodiments of the present invention have been described and shown in details, the present invention is not limited to such details and the embodiment herein shown may be modified in numerous manners without departing from the spirit and scope of the present invention.

What is claimed is:

1. A yarn drawing and measuring device for use in a weaving loom, comprising; a measuring roller rotatable about a substantially horizontal axis; pressing means comprising a pressing roller rotatable about an axis substantially parallel to the axis of rotation of the measuring roller, the pressing roller being movable between a first relative position thereof disengaged from said measuring roller and a second relative position thereof in rolling contact with the measuring roller; positioning means for selectively moving said pressing roller into said first and second relative positions, said positioning means having a first condition holding said pressing roller in said first relative position and a second condition holding the pressing roller in said second relative position; and driving means for driving the pressing roller in a direction of rotation opposite to the direction of rotation of the measuring roller at a circumferential speed substantially equal to the circumferential speed of rotation of the measuring roller in either of the relative positions of the pressing roller, said driving means including self-adjustable torque transmission means having at least one deformable member constantly engaging said pressing roller and elastically deformable responsive to the movement of the pressing roller between said first and second relative positions.

2. A yarn drawing and measuring device as set forth in claim 1, in which said driving means further include a driving roller which is rotatable about an axis substantially parallel with the axes of rotation of the measuring and pressing rollers and which is connected to said pressing roller through said deformable member, said pressing roller having its axis of rotation substantially aligned with the axis of rotation of the driving roller when the pressing roller is in one of said first and second relative positions, and out of alignment with the axis of rotation of the driving roller when the pressing roller is in the other of the first and second relative positions thereof, said driving roller being driven for driving said pressing roller through said deformable member throughout an operating period of the yarn drawing and measuring device.

3. A yarn drawing and measuring device as set forth in claim 2, in which said deformable member consists of an elongate pliable member which is anchored at its opposite ends to mutually opposite inner side faces of the pressing and driving rollers and which is substantially in parallel to the axes of rotation of the pressing and driving rollers when the axes are substantially aligned with each other.

4. A yarn drawing and measuring device as set forth in claim 2, in which said deformable member consists of a tubular pliable member which is connected at its opposite axial ends to mutually opposite inner side faces of said pressing and driving rollers and which has an axis substantially parallel to the axes of the pressing and driving rollers when the axes are substantially aligned with each other.

5. A yarn drawing and measuring device as set forth in claim 2, in which said driving roller is in rolling contact with said measuring roller and is driven by the measuring roller.

6. A yarn drawing and measuring device as set forth in claim 2, in which said driving means further comprise a driving pulley rotatable with said measuring roller, a driven pulley rotatable with said driving pulley, and an endless belting passed on the driving and driven pulleys in intermediately crossed relationship for transmitting a driving torque to said driving roller through the driving pulley, the belting and the driven pulley.

7. A yarn drawing and measuring device as set forth in claim 5, in which said pressing and driving rollers have substantially equal diameters.

8. A yarn drawing and measuring device as set forth in claim 1, in which said driving means further comprise a primary driving roller connected to a driving source and rotatable about an axis parallel to the axes of rotation of said measuring and pressing rollers, the primary driving roller being driven from said driving source to rotate in the same direction as the direction of rotation of said measuring roller, and a secondary driving roller rotatable about an axis parallel to the axis of said primary driving roller and in rolling contact with the primary driving roller, said secondary driving roller being connected to said pressing roller through said deformable member, the axis of rotation of said pressing roller being substantially in alignment with the axis of rotation of said secondary driving roller when the pressing roller is in either of said first and second relative positions and being out of alignment with the axis of the secondary driving roller when the pressing roller is in the other of the first and second relative positions.

9. A yarn drawing and measuring device as set forth in claim 8, in which said deformable member consists of an elongate pliable member which is anchored at its opposite ends to mutually opposite inner side faces of the pressing and secondary driving rollers and which is substantially parallel to the axes of rotation of the pressing and secondary driving rollers when the axes are substantially in alignment with each other.

10. A yarn drawing and measuring device as set forth in claim 8, in which said deformable member consists of a tubular pliable member which is fixedly connected at its opposite axis ends to mutually opposite axial ends of the pressing and secondary driving rollers and which is substantially parallel to the axes of rotation of the pressing and secondary driving rollers when the axes are substantially aligned with each other.

11. A yarn drawing and measuring device as set forth in claim 1, in which said deformable member consists of a disc formed of an elastic material and rotatable about an axis substantially parallel to the axes of rotation of said measuring and pressing rollers, said disc being driven for driving said pressing roller at said circumferential speed and locally deformed responsive to the movement of the pressing roller between said first and second relative positions while rotating about its axis.

12. A yarn drawing and measuring device as set forth in claim 11, in which said disc is rotatable with said pressing roller and in rolling contact with said measuring roller for being locally deformed at its circumferential portion depressed by the measuring roller when the pressing roller is in the second relative position thereof.

13. A yarn drawing and measuring device as set forth in claim 11, in which said disc is rotatable with said measuring roller and in rolling contact with said pressing roller for being locally deformed at its circumferential portion depressed by the pressing roller when the pressing roller is in said second relative position thereof.

14. A yarn drawing and measuring device as set forth in claim 11, in which said disc is driven by an external driving source and is constantly in rolling contact with said pressing roller for being locally deformed at its portion depressed by the pressing roller when the pressing roller is in said second relative position thereof.

15. A yarn drawing and measuring device as set forth in claim 1, in which said driving means further include a driving pulley rotatable with said measuring roller and a driven roller rotatable with said pressing roller and movable with the pressing roller as the pressing roller is moved between said first and second relative positions thereof and in which said deformable member consists of an elastically stretchable endless belting passed on said driving and driven pulleys in intermediately crossed relationship for driving the driven pulley to rotate in a direction opposite to the direction of rotation of the driving pulley when driven by the driving pulley, said endless belting having a normal length responsive to the pressing roller held in the second relative position thereof and being elastically stretched from the normal length responsive to the movement of the pressing roller from the second relative position to the first relative position thereof.

16. A yarn drawing and measuring device as set forth in claim 1, in which said pressing means includes a second pressing roller rotatable and movable similarly to said pressing roller, the pressing rollers being connected to each other by said self-adjustable torque transmission means for being driven together at substantially equal circumferential speeds by either pressing roller held in said second relative position thereof, said positioning means being operative to selectively move the pressing rollers between the first and second relative positions thereof for alternatively positioning said pressing rollers in said second relative position thereof.

17. A yarn drawing and measuring device as set forth in claim 16, in which said self-adjustable torque transmission means comprise a plurality of substantially uniformly spaced pliable elongate connecting members each of which is anchored at its opposite ends to the opposite inner side faces of the first and second pressing rollers and which is substantially parallel to the axes of rotation of the first and second pressing rollers when said axes are substantially aligned with each other.

18. A yarn drawing and measuring device as set forth in claim 16, in which said self-adjustable torque transmission means comprise a tubular pliable connecting member which is fixedly connected at its opposite axial ends to the opposite inner axial ends of the first and second pressing rollers and which has an axis substantially parallel to the axes of rotation of the first and second pressing rollers when said axes are substantially aligned with each other.

19. A yarn drawing and measuring device as set forth in claim 16, in which said first and second measuring rollers have substantially equal diameters.

20. A yarn drawing and measuring device as set forth in claim 1, in which said positioning means comprise a lever which is rockable about an axis substantially parallel to the axes of rotation of said measuring and pressing rollers and which has a portion extending over the top of said measuring roller and rotatably carrying said pressing roller on said portion, said lever being rockable between a first angular position providing said first relative position of the pressing roller and a second angular position providing said second relative position of the pressing roller, a driving unit engaging the lever for driving the lever into said first angular position when actuated, and resilient biasing means operative to urge the lever toward the second angular position thereof for moving the lever into the second angular position when said driving unit is inoperative.

* * * * *